US008624790B2

(12) United States Patent
Lai et al.

(10) Patent No.: US 8,624,790 B2
(45) Date of Patent: Jan. 7, 2014

(54) POROUS MAGNETIC ANTENNA

(75) Inventors: Wen-Cheng Lai, Taishan Township, Taipei County (TW); Ching-Wen Hsue, Taipei (TW); Li-Ming Lo, Taipei Hsien (TW)

(73) Assignee: Mingchi University of Technology, Taipei Hsien (TW)

( * ) Notice: Subject to any disclaimer, the term of this patent is extended or adjusted under 35 U.S.C. 154(b) by 590 days.

(21) Appl. No.: 12/689,447

(22) Filed: Jan. 19, 2010

(65) Prior Publication Data

US 2011/0006962 A1 Jan. 13, 2011

(30) Foreign Application Priority Data

Jul. 13, 2009 (TW) ..... 98123573 A

(51) Int. Cl.
*H01Q 1/38* (2006.01)

(52) U.S. Cl.
USPC ..... 343/787; 343/700 MS

(58) Field of Classification Search
USPC ..... 343/700 MS, 787, 846
See application file for complete search history.

(56) References Cited

U.S. PATENT DOCUMENTS 5,061,943 A * 10/1991 Rammos ..... 343/770
6,597,318 B1 * 7/2003 Parsche et al. ..... 343/700 MS
7,924,235 B2 * 4/2011 Fujimoto et al. ..... 343/787

* cited by examiner

*Primary Examiner* — Michael C Wimer
(74) *Attorney, Agent, or Firm* — Guice Patents PLLC

(57) ABSTRACT

The present invention relates to a porous magnetic antenna, comprising: an antenna; an insulating layer, having one side next to said antenna; and a magnetic layer, placed next to the other side of the insulating layer, separated from said antenna with a distance, and having at least one hole. The porous magnetic antenna has the advantages of shaping the field pattern, lowering the sensitivity, improving the gain value and possessing stable directionality.

12 Claims, 6 Drawing Sheets

POROUS MAGNETIC ANTENNA

BACKGROUND OF THE INVENTION

1. Field of the Invention

The present invention follows what is disclosed in a TIPO patent application with application number 098110021. The present invention relates to a magnetic antenna, especially to a porous magnetic antenna, of which a magnetic layer comprising at least one hole for altering the original field pattern and the gain value of an antenna, so that the antenna can possess stable directionality.

2. Description of the Related Art

In recent years, due to the practical applications of wireless communication and the popularization of hi-tech products, the communication industry has had new breakthroughs and achievements. As a variety of electronic communication products and wireless communication equipments have been applied in our daily life, the antenna, especially the planar antenna, broadly found in the wireless communication systems, is gaining a lot of attention due to its simple manufacture process and small form factor. Common planar antenna includes microstrip antenna, printed antenna, planar inverted-F antenna, etc.

However, the common antenna has fixed characteristics, no matter of what type it is—for example, the EM wave field pattern radiated from an antenna is usually of omni-direction type and can not be changed—while there are occasions where EM wave intensity needs to be enhanced in some specific direction. For example, when using a mobile phone in a tunnel, it is desirable to enhance the antenna's EM wave in the direction towards the exits of the tunnel, or alter the EM field pattern to a directional one directing towards the exits of the tunnel to improve the mobile phone communication quality in the tunnel.

It is found that the Taiwan TW466,799 patent has disclosed an antenna comprising an EMI snubber, which utilizes a magnetic means having soft magnetic powder to cover the antenna for controlling the field pattern to reduce the antenna's EM radiation against human body. However, the magnetic means is mainly for shielding or inhibiting EMI, and the field pattern still does not possess directionality though part of the field pattern is altered.

It is also found that the U.S. Pat. No. 6,768,476 patent "Capacitively-loaded bent-wire monopole on an artificial magnetic conductor" has disclosed an antenna consisting of a thin strip bent-wire monopole disposed on an artificial magnetic conductor (AMC), to achieve an electrically small antenna for use in handheld wireless devices without suffering a substantial loss of efficiency. However, the antenna disposed on an artificial magnetic conductor can not change the antenna's field pattern to enhance the gain in some specific direction, though it can reduce the substantial loss.

Further, it is found that the Taiwan TW466,799 patent "Directional antenna" has disclosed a directional antenna, which utilizes a hybrid magnetic means having soft magnetic powder and an oxide film layer to cover the antenna for shielding or inhibiting EMI, but it still can not change the antenna's field pattern to enhance the gain in some specific direction.

To conquer the disadvantages of the prior art antennas mentioned above, the present invention proposes a porous magnetic antenna.

SUMMARY OF THE INVENTION

One objective of the present invention is to provide a porous magnetic antenna, of which a magnetic layer has at least one hole to alter the original field pattern of the antenna.

Another objective of the present invention is to provide a porous magnetic antenna, of which a magnetic layer has at least one hole to enhance the gain value of the antenna.

Another objective of the present invention is to provide a porous magnetic antenna, of which a magnetic layer has at least one hole to induce directionality of the antenna.

Still another objective of the present invention is to provide a porous magnetic antenna, of which a magnetic layer has at least one hole to reduce the sensitivity of the antenna.

To achieve the foregoing objectives, the present invention provides a porous field pattern shaping device to alter a field pattern of an antenna, at least comprising: a magnetic layer, having at least one hole, placed beside said antenna, and separated from said antenna with a distance.

To make it easier for our examiner to understand the objective of the invention, its structure, innovative features, and performance, we use a preferred embodiment together with the accompanying drawings for the detailed description of the invention.

DETAILED DESCRIPTION OF THE PREFERRED EMBODIMENTS

The present invention will be described in more detail hereinafter with reference to the accompanying drawings that show the preferred embodiment of the invention.

Figure 1:
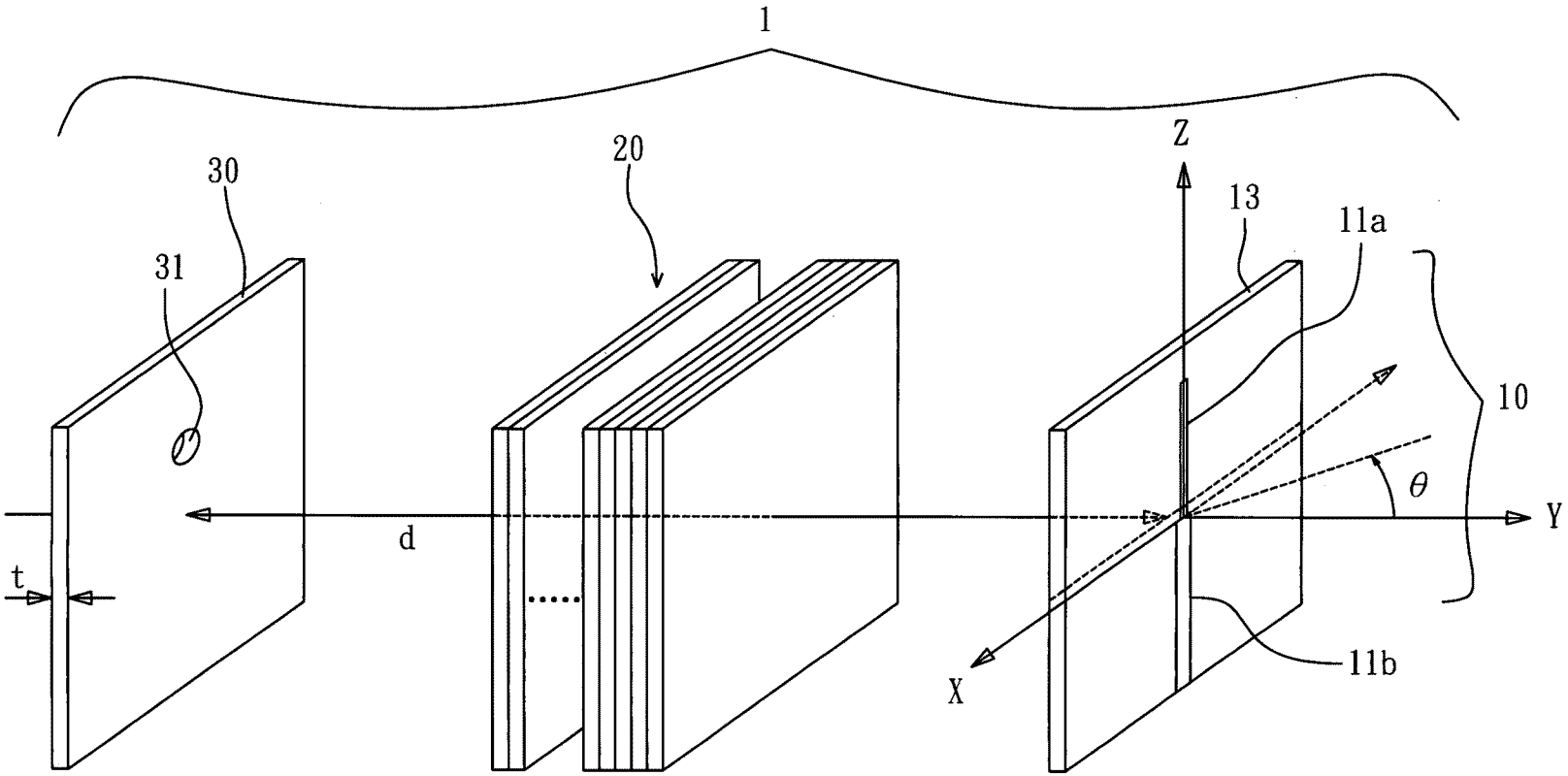
FIG. 1 is a breakdown diagram of a porous magnetic antenna according to a preferred embodiment of the present invention.
Figure 2B:
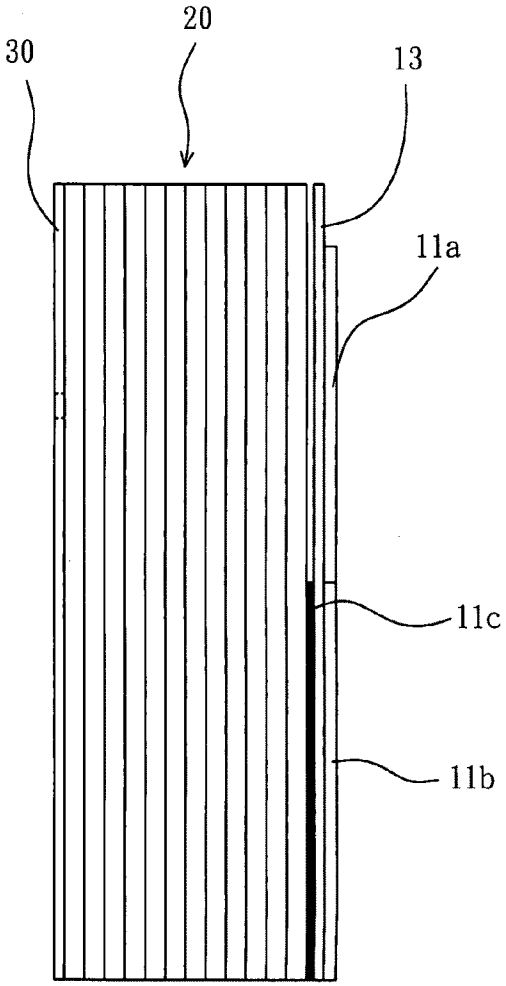
FIG. 2*b* is a left side view of a porous magnetic antenna according to a preferred embodiment of the present invention.
Figure 2A:
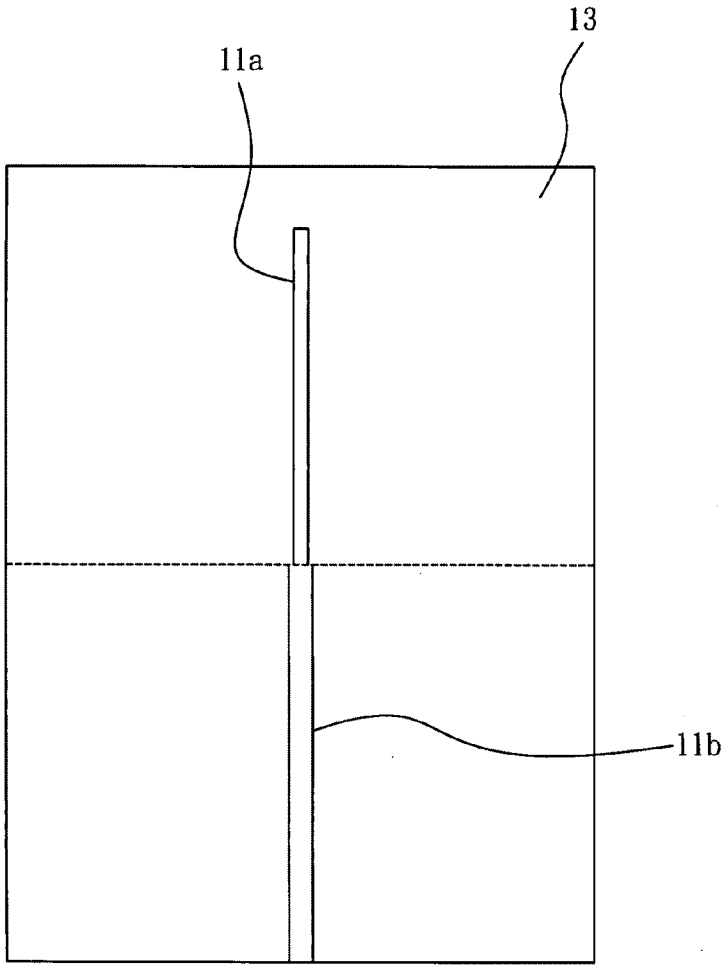
FIG. 2*a* is a front view of a porous magnetic antenna according to a preferred embodiment of the present invention.
Figure 3:
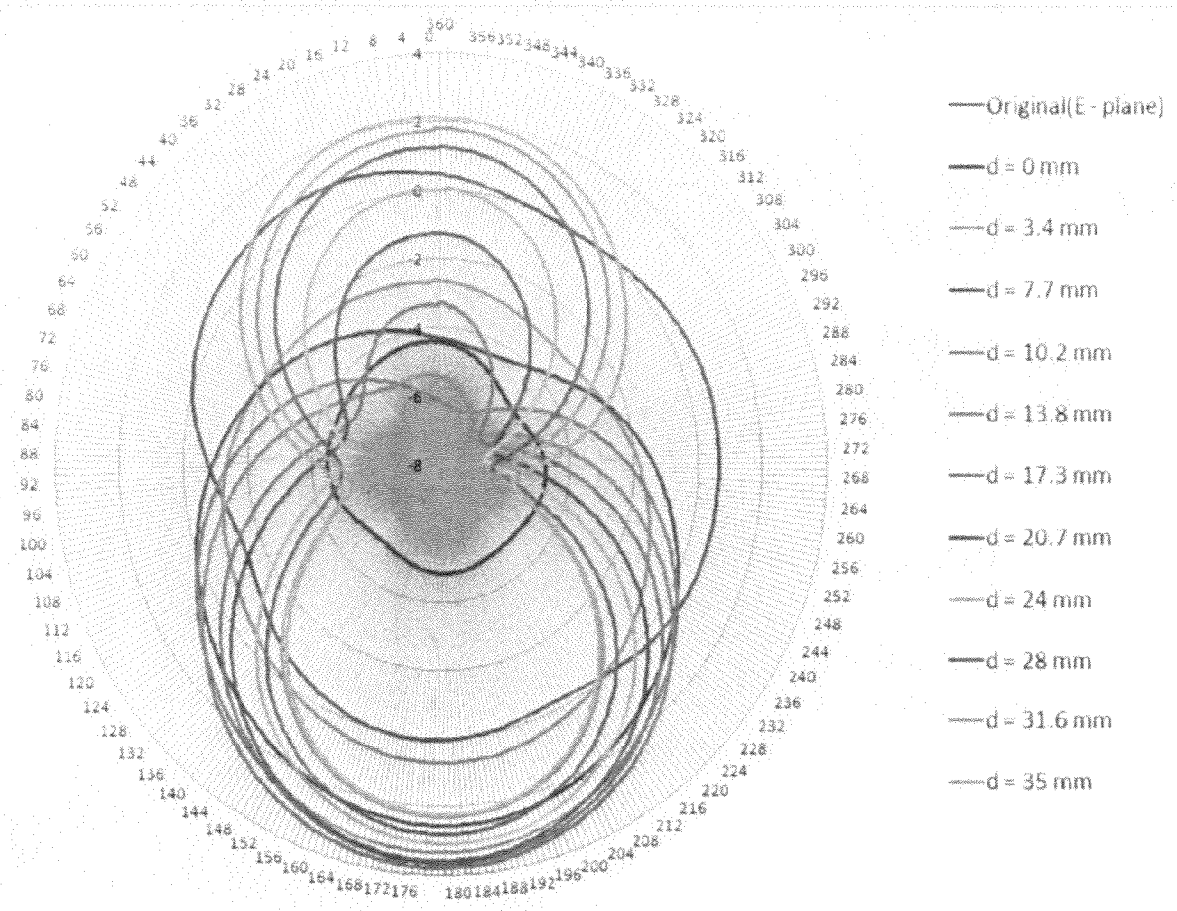
FIG. 3 shows the field patterns of a porous magnetic antenna according to a preferred embodiment of the present invention.
Figure 4:
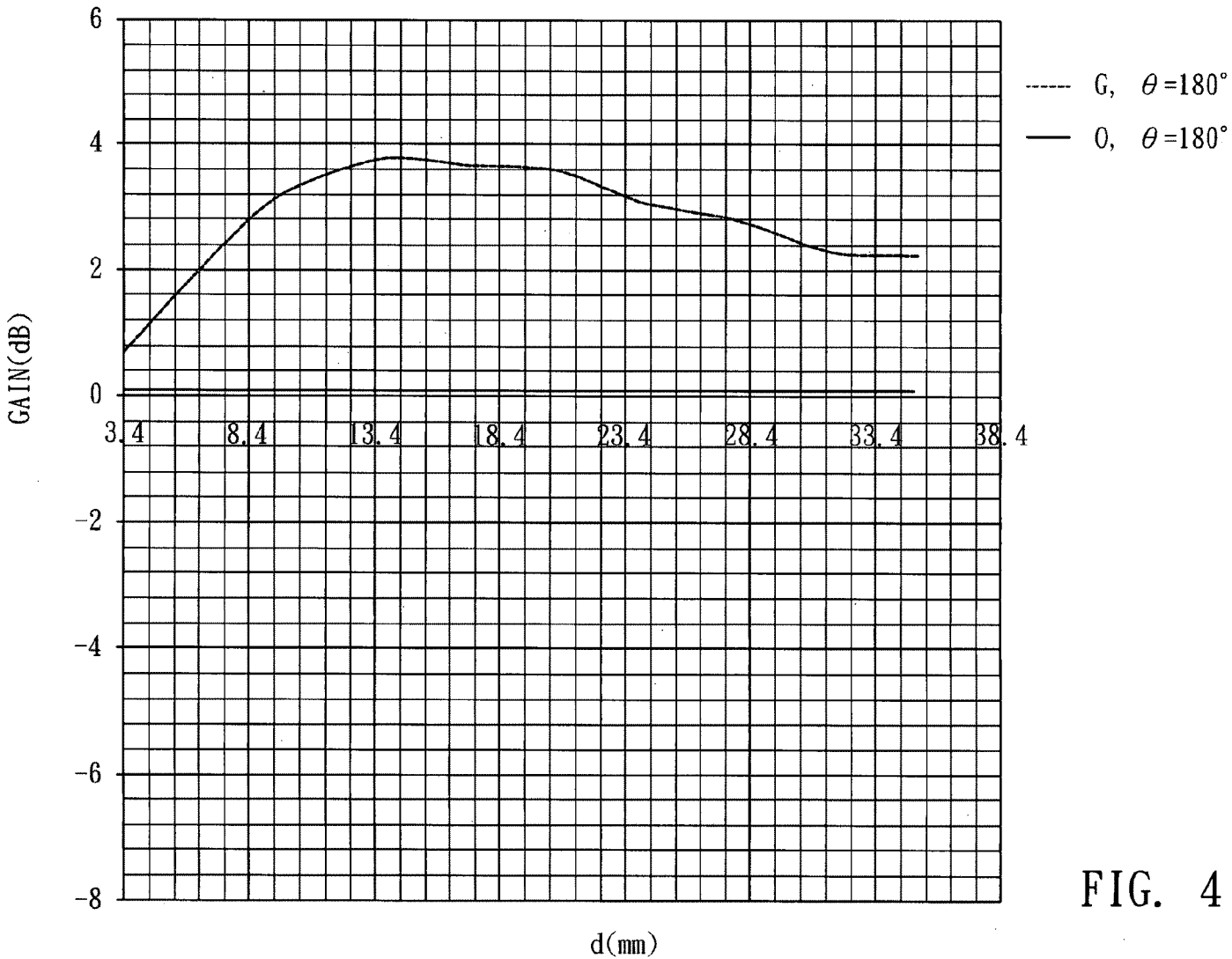
FIG. 4 shows a gain vs. distance profile of a porous magnetic antenna according to a preferred embodiment of the present invention.

Please refer to FIG. 1-4, wherein FIG. 1 shows a breakdown diagram of a porous magnetic antenna according to a preferred embodiment of the present invention; FIG. 2*a* shows a front view of a porous magnetic antenna according to a preferred embodiment of the present invention; FIG. 2*b* shows a left side view of a porous magnetic antenna according to a preferred embodiment of the present invention; FIG. 3 shows the field patterns of a porous magnetic antenna according to a preferred embodiment of the present invention; FIG. 4 shows a gain vs. distance profile of a porous magnetic antenna according to a preferred embodiment of the present invention.

As shown in the figures, the porous magnetic antenna 1 comprises an antenna 10, an insulating layer 20 and a magnetic layer 30.

In the structure, the antenna 10 is a monopole microstrip antenna fixed on a substrate 13, having a line structure 11*a*, a feed line 11*b* and a ground contact 11*c*. The line structure 11*a* mainly acts as a cavity for 2.4 GHz resonant frequency to contribute the most part of radiation. The feed line 11*b* is used to feed a radiation signal to the line structure 11*a*. The back side of the feed line 11*b* is the ground contact 11*c*. The contact point of the line structure 11*a* and the feed line 11*b* is presumed as the origin of a Cartesian coordinate system having x-axis, y-axis and z-axis. The substrate 13 is in parallel with x-axis and perpendicular to y-axis, and the angle θ shown in the figures is the angle of a vector on xy plane relative to y-axis.

The insulating layer 20, placed at one side—for example but not limited to left side—of the antenna 10, comprises preferably but not limited to expanded polystyrene with a thickness around 3 mm. The porous magnetic antenna 1 can have the antenna 10 separated from the magnetic layer 30 with a distance controlled by the number of the insulating layer 20.

The magnetic layer 30, having at least one hole 31, is located at the other side—for example but not limited to left side—of the insulating layer 20 in a parallel manner, and separated from the antenna 10 with a distance d. The magnetic layer 30 has a thickness of t, and the relative permeability $\mu_r$ of which is higher than 10. The magnetic layer 30 can be viewed as an absorber—a flexible laminate constructed by uniting a magnetic material and a plastic material—originally used to shield an EMI of some specific frequency, of which the absorption effect is dependent on the thickness and the density of the magnetic material, i.e. dependent closely on the permeability. Besides, the present invention sets the ratio of the distance d relative to the thickness of the magnetic layer 30 to be, for example but not limited to, between 14 and 15.

The hole 31 is formed on the magnetic layer 30 at a place corresponding to the maximal current intensity location on the antenna 10. The magnetic layer 30 having the hole 31 influences the transmission of the EM waves emitted by the antenna 10 in a way that it allows part of the EM waves pass through freely and part of them be effected, so it can change the field pattern. In regards to performance, the magnetic layer 30 having holes of certain shape, size and number, can provide much more the effect of field pattern stabilization and gain value enhancement (when shielding distance d≥4 mm, the gain value is always greater than that of the original field pattern) than the magnetic layer having no hole, and as the enhanced gain is insensitive to the shielding distance variation, the field pattern is stabilized. When the antenna 10 is installed without the magnetic layer 30 having the hole 31, it possesses an original field pattern; when the magnetic layer 30 having the hole 31 is added in, the antenna 1 is formed and the field pattern is changed. The field pattern is therefore can be switched between two patterns.

As shown in FIG. 3, it indicates an E-plane diagram of the radiated field pattern when the magnetic layer 30 having a round hole 31 is installed. With the magnetic layer 30 having a round hole 31 installed, the field pattern of the magnetic antenna can be altered by adjusting the distance d. When the magnetic layer 30 having the hole 31 is not added in, the field pattern of the antenna 10 is near to the omni-direction type; when the magnetic layer 30 having the hole 31 is installed with the insulating layer 20 controlling its distance from the antenna 10, the field pattern will gradually change to be directional as the distance increases, and becomes obviously north-south oriented when the distance is 35 mm. Therefore, by forming a round hole 31 on the magnetic layer 30, and by changing the distance d between the antenna 10 and the magnetic layer 30, the field pattern can be changed from omni-directional to directional, and a function of field patterns switching is proposed.

As shown in FIG. 4, it indicates a gain vs. distance profile when the magnetic layer 30 having a round hole 31 is installed. With the thickness t of the magnetic layer 30 being 1 unit, the magnetic layer 30 being in parallel with the antenna 10, θ=180°, the profile of antenna gain vs. distance d of the antenna installed with the magnetic layer 30 not having the hole 31, and the profile of antenna gain vs. distance d of the antenna installed with the magnetic layer 30 having the hole 31 are measured. There are two gain profiles in FIG. 4, including a gain profile O corresponding to θ=180° and the magnetic layer 30 not having the hole 31, and a profile G corresponding to θ=180° and the magnetic layer 30 having the hole 31. As can be seen in FIG. 4, when the distance d is 13.4 mm, the gain of the gain profile G is up to 3.7 dB, the gain of the gain profile O is around 0 dB, the gain profile G has positive gain values over all the settings of the distance d, and the gain profile O has zero gain value over all the settings of the distance d. As the magnetic layer 30 having the hole 31 can increase the gain value of the antenna 10, the volume of the insulating layer 20 can be reduced to cut the production cost with a gain value requirement still being met. FIG. 4 is drew under θ=180°, but it is not intended to be limited thereof. For example, when θ=0°, the resulted effect is similar.

Figure 5:
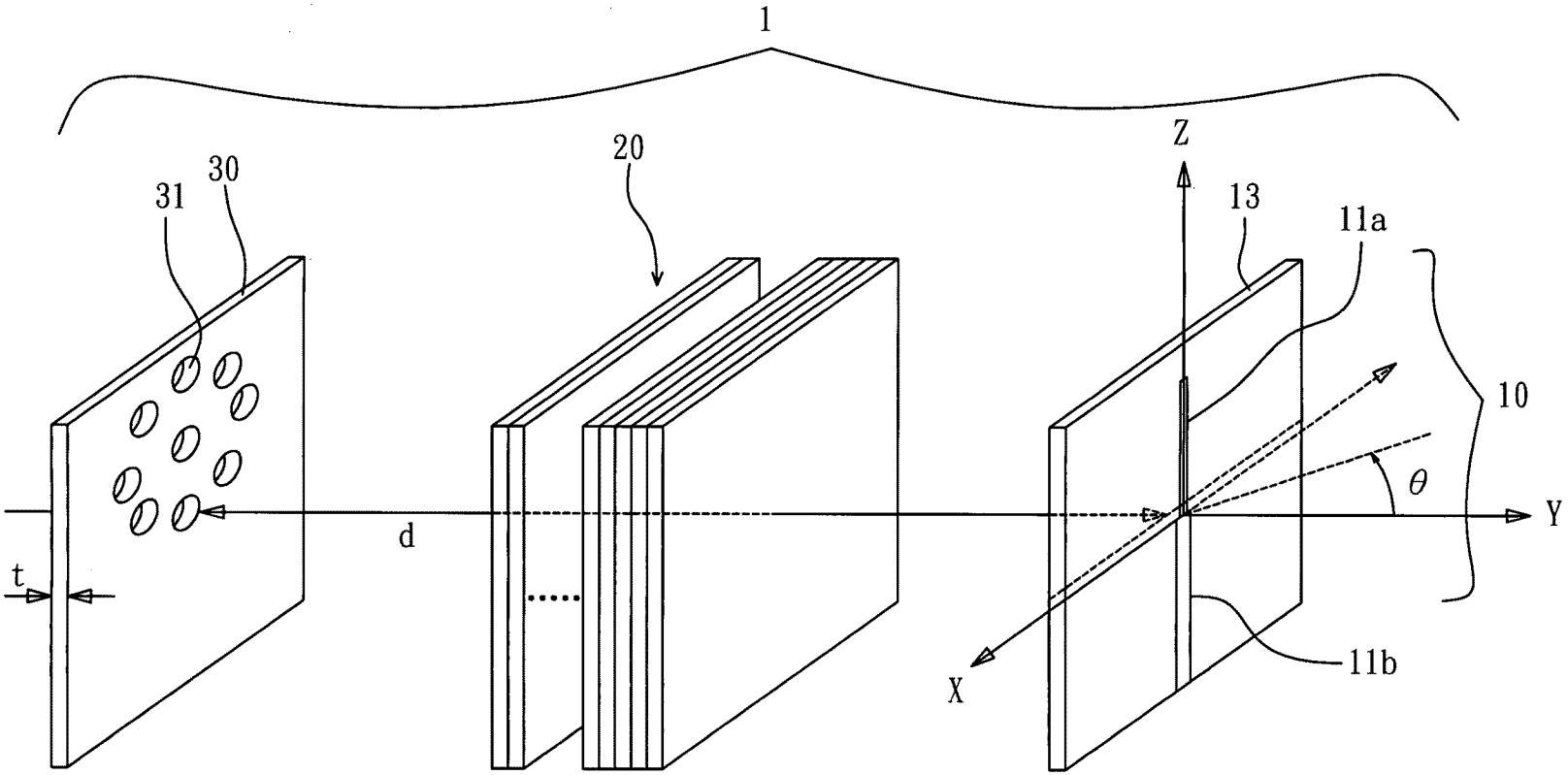
FIG. 5 is a breakdown diagram of another porous magnetic antenna according to a preferred embodiment of the present invention.

Please refer to FIG. 5, which shows a breakdown diagram of another porous magnetic antenna according to a preferred embodiment of the present invention. As shown in the figure, the magnetic layer 30 has a plurality of holes 31, and it can also attain the effects mentioned in the above embodiment. Since the principle is disclosed above, it will not be addressed here.

Figure 6:
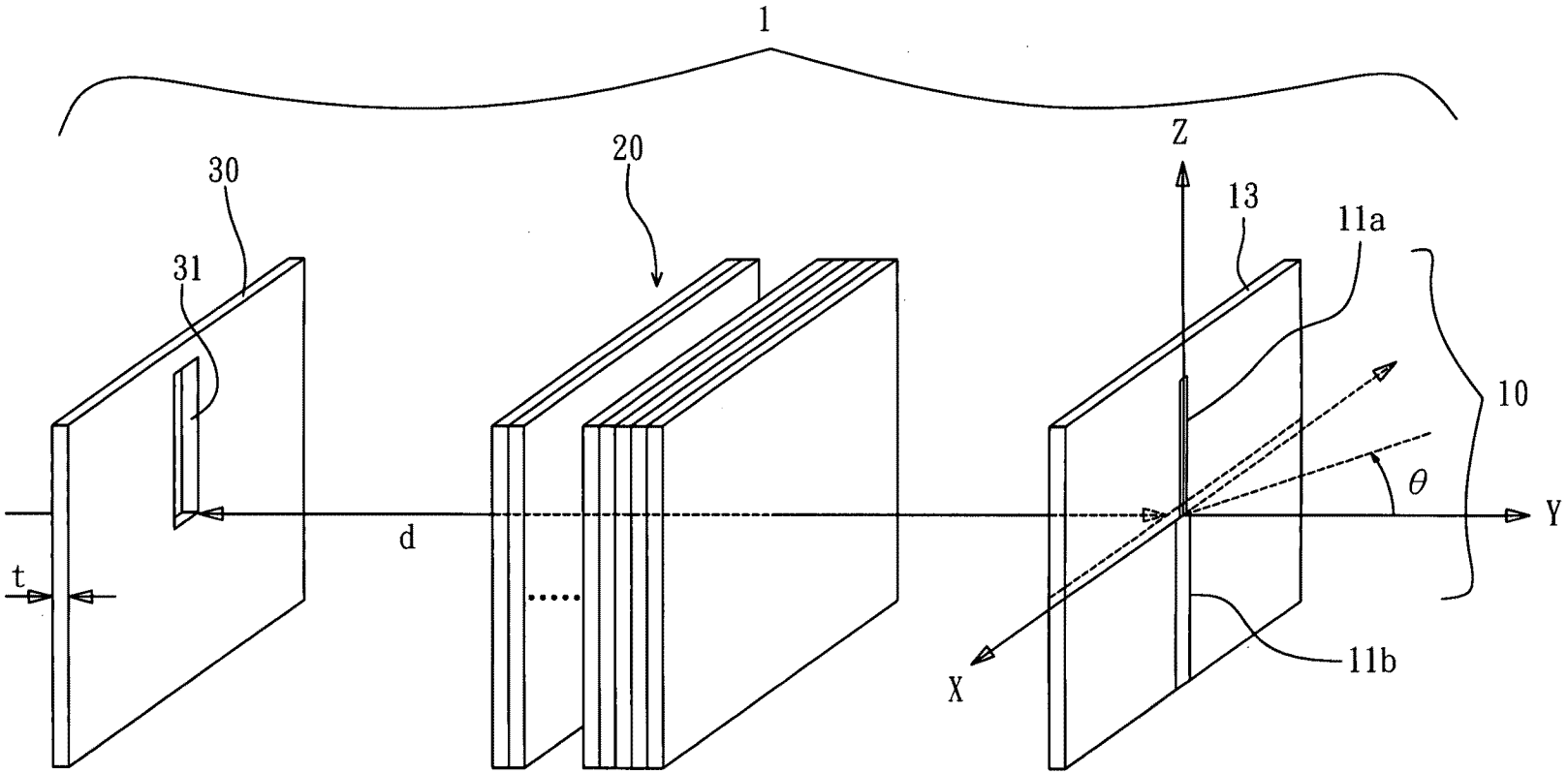
FIG. 6 is a breakdown diagram of another porous magnetic antenna according to a preferred embodiment of the present invention.

Please refer to FIG. 6, which shows a breakdown diagram of another porous magnetic antenna according to a preferred embodiment of the present invention. As shown in the figure, the magnetic layer 30 has a rectangle hole 31, and it can also attain the effects mentioned in the above embodiment. Since the principle is disclosed above, it will not be addressed here. As a result, the porous magnetic antenna of the present invention has gained improvement relative to the prior art.

In summary, through the implement of the porous magnetic antenna of the present invention, of which a magnetic layer comprising at least a hole, a variety of advantages can be offered: 1. the original field pattern of the antenna can be changed; 2. the gain value of the antenna can be increased; 3. the antenna can become less sensitive to distance variation, so the porous magnetic antenna of the present invention has indeed conquer the disadvantages of the prior art.

While the invention has been described by way of examples and in terms of preferred embodiments, it is to be understood that the invention is not limited thereto. To the contrary, it is intended to cover various modifications and similar arrangements and procedures, and the scope of the appended claims therefore should be accorded the broadest interpretation so as to encompass all such modifications and similar arrangements and procedures.

In summation of the above description, the present invention herein enhances the performance than the conventional structure and further complies with the patent application requirements and is submitted to the Patent and Trademark Office for review and granting of the commensurate patent rights.

What is claimed is:

1. A porous magnetic antenna comprising:

an antenna being a monopole microstrip antenna fixed on a substrate and having a line structure, a feed line, and a ground contact located on a backside of the feed line, the substrate is located between the ground contact and the feed line;

an insulating layer; and a magnetic layer being an absorber and having at least one hole, said at least one hole is formed on said magnetic layer at a location corresponding to a maximal current intensity location on said antenna, said magnetic layer is spaced apart from said antenna a distance, said insulating layer is located between said antenna on a first side thereof and said magnetic layer located on a second side thereof, the ground contact is located directly between the substrate and the insulating layer;

wherein the relative permeability of said magnetic layer is higher than 10.

2. The porous magnetic antenna as claim 1, wherein said insulating layer comprises expanded polystyrene with a thickness around 3 mm, and the number of which is used to control said distance.

3. The porous magnetic antenna as claim 1, wherein said magnetic layer comprises a magnetic material and a plastic material.

4. The porous magnetic antenna as claim 1, wherein a ratio of said distance between said magnetic layer and said antenna relative to a thickness of said magnetic layer is between 14 and 15.

5. The porous magnetic antenna as claim 1, wherein said hole has a shape selected from a group consisting of a round shape and a rectangle shape.

6. The porous magnetic antenna as claim 1, wherein said hole is formed on said magnetic layer at a place corresponding to a maximal current intensity location on said antenna.

7. A porous field pattern shaping device comprising:

an antenna being a monopole microstrip antenna fixed on a substrate and having a line structure, a feed line, and a ground contact located on a backside of the feed line, the substrate is located between the ground contact and the feed line; and a magnetic layer having at least one hole for altering a field pattern of said antenna, said magnetic layer is spaced apart from said antenna a distance, wherein said magnetic layer comprises a magnetic material and a plastic material, and the relative permeability of said magnetic layer is higher than 10.

8. The porous field pattern shaping device as claim 7, further comprising an insulating layer located between said antenna on a first side thereof and said magnetic layer located on a second side thereof and controlling the distance between said magnetic layer and said antenna;

wherein the ground contact is located directly between the substrate and the insulating layer.

9. The porous field pattern shaping device as claim 8, wherein said insulating layer comprises expanded polystyrene with a thickness around 3 mm.

10. The porous field pattern shaping device as claim 7, wherein a ratio of said distance between said magnetic layer and said antenna relative to a thickness of said magnetic layer is between 14 and 15.

11. The porous field pattern shaping device as claim 7, wherein said hole has a shape selected from a group consisting of a round shape and a rectangle shape.

12. The porous field pattern shaping device as claim 7, wherein said hole is formed on said magnetic layer at a place corresponding to the maximal current intensity location on said antenna.

* * * * *